US007090263B2

(12) United States Patent
Quigley et al.

(10) Patent No.: US 7,090,263 B2
(45) Date of Patent: Aug. 15, 2006

(54) DOOR LATCHING DEVICE AND METHOD

(75) Inventors: John Patrick Quigley, Watertown, WI (US); Terry Ludwig, Oconomowoc, WI (US)

(73) Assignee: SPX Corporation, Charlotte, NC (US)

( * ) Notice: Subject to any disclaimer, the term of this patent is extended or adjusted under 35 U.S.C. 154(b) by 633 days.

(21) Appl. No.: 09/848,413

(22) Filed: May 4, 2001

(65) Prior Publication Data

US 2002/0163208 A1 Nov. 7, 2002

(51) Int. Cl.
*E05C 19/00* (2006.01)

(52) U.S. Cl. ..... 292/302; 292/158; 292/161; 292/DIG. 20; 292/DIG. 33; 292/DIG. 47; 49/394

(58) Field of Classification Search ..... 292/302, 292/341.15, 158, 156, 157, DIG. 69, DIG. 47, 292/DIG. 33, DIG. 20, 159, 161, DIG. 27, 292/DIG. 68, 341.19; 49/274, 394
See application file for complete search history.

(56) References Cited

U.S. PATENT DOCUMENTS 2,138,933 A * 12/1938 Moseley ..... 292/143
3,981,054 A * 9/1976 Hull et al. ..... 27/17
4,341,409 A * 7/1982 Sakoda ..... 219/724
4,493,499 A * 1/1985 Stenglein ..... 292/158
4,497,993 A * 2/1985 Aoyama ..... 126/197
4,500,122 A * 2/1985 Douglas ..... 292/161
4,542,269 A * 9/1985 Sakoda ..... 126/197
4,803,808 A * 2/1989 Greisner ..... 49/394
4,807,914 A * 2/1989 Fleming et al. ..... 292/48
4,878,699 A * 11/1989 Wronski ..... 292/143
4,955,159 A * 9/1990 Rogers ..... 292/226
4,982,063 A * 1/1991 Tsunekawa et al. ..... 126/197
4,991,886 A * 2/1991 Nolte et al. ..... 292/161
5,012,794 A * 5/1991 Faurel ..... 126/191
5,081,793 A * 1/1992 Mauro ..... 49/501
5,087,087 A * 2/1992 Vetter et al. ..... 292/241
5,118,145 A * 6/1992 Tucker ..... 292/158
5,219,195 A * 6/1993 Lawrence ..... 292/161
5,289,655 A * 3/1994 Marmora et al. ..... 49/141
5,318,333 A * 6/1994 Dreifert ..... 292/336.3
5,370,428 A * 12/1994 Dreifert et al. ..... 292/161

(Continued)

FOREIGN PATENT DOCUMENTS

GB 2164382 * 3/1986

*Primary Examiner*—Brian E. Glessner
*Assistant Examiner*—Carlos Lugo
(74) *Attorney, Agent, or Firm*—Baker & Hostetler LLP

(57) ABSTRACT

An apparatus for latching a door against a frame has a door pin extending from the door and a handle lever rotatably mounted to the door and having an extending handle pin. A latch bar is mounted for reciprocating travel relative to the frame, the latch bar having a first slot having a cam surface adapted to receive the door pin, and a second slot adapted to receive the handle pin. The latch bar and handle have a first position where the handle pin enters the second slot and the door pin enters the first slot, and a second position where the handle pin contacts the second slot and the cam surface bears against the door pin. Rotation of the handle when the latch bar is in the first position causes the handle pin to bear against the second slot, moving the latch bar in a latching direction from the first position to the second position, so that the first slot on the cam surface bears against the door pin and urges the door in a closing direction.

19 Claims, 8 Drawing Sheets

U.S. PATENT DOCUMENTS 5,398,446 A * 3/1995 Kunert ..... 49/153
5,531,045 A * 7/1996 Piltingsrud ..... 49/279
RE35,463 E * 2/1997 Vetter et al. ..... 292/241
5,741,031 A * 4/1998 Bauman et al. ..... 292/139
5,791,700 A * 8/1998 Biro ..... 292/36
5,829,802 A * 11/1998 Anderson et al. ..... 292/139
5,906,403 A * 5/1999 Bestler et al. ..... 292/117
5,927,767 A * 7/1999 Smith et al. ..... 292/139
6,109,668 A * 8/2000 Demarco ..... 292/143
6,135,511 A * 10/2000 Smith et al. ..... 292/139
6,161,881 A * 12/2000 Babka et al. ..... 292/26
6,230,457 B1 * 5/2001 Brautigam ..... 52/204.69
6,302,098 B1 * 10/2001 Smith ..... 126/197
6,367,853 B1 * 4/2002 Briggs ..... 292/336.3

* cited by examiner

DOOR LATCHING DEVICE AND METHOD

FIELD OF THE INVENTION

The present invention relates generally to a device and method for latching a door closed against a door frame.

BACKGROUND OF THE INVENTION

Various arrangements for latching a door closed against a frame are known. Some of these latches are used with gasket-sealed doors that swing from a hinge on one side of the door. A known type of latch employs a power-operated reciprocating latch bar having a cam surface that engages and captures a pin or roller on the door and urges the pin in the closed direction to hold the door closed. The latch bar may be pneumatically operated and the cam surface may be provided on a slot opening in the bar so that as the door swings into a closed position, the pin on the door swings into the slot. In some applications the camming contact of the latch bar and pin may urge the door closed against an opposing force provided by compression of a resilient gasket provided between the door and the door frame.

A disadvantage of this known arrangement is that it requires power operation of the latch bar, adding complexity to the overall device. Accordingly, it would be desirable to have a door latch that can be manually operated.

SUMMARY OF THE INVENTION

In accordance with one embodiment of the present invention, an apparatus for latching a door against a frame is provided. The apparatus includes a door pin extending from the door and a handle lever rotatably mounted to the door and having a handle pin extending therefrom. A latch bar is mounted for reciprocating travel relative to the frame. The latch bar has a first slot having a cam surface adapted to receive the door pin, and a second slot adapted to receive the handle pin. The latch bar and handle have a first position where the handle pin enters the second slot and the door pin enters the first slot, and a second position where the handle pin contacts the second slot and the cam surface bears against the door pin. Rotation of the handle when the latch bar is in the first position causes the handle pin to bear against the second slot, moving the latch bar in a latching direction from the first position to the second position, so that the first slot on the cam surface bears against the door pin and urges the door in a closing direction.

In accordance with another embodiment of the present invention, an apparatus for latching a door against a frame has a first engagement means extending from the door; a second engagement means mounted to the door frame and movable between two positions for engaging with the first engagement means in the second position; and actuating means for actuating the second engagement means between the first and second positions. The actuating means includes a rotating handle having a handle pin extending therefrom that contacts a slot provided in the second engagement means to move the second engagement means from the first to the second positions when the handle is rotated.

In accordance with another embodiment of the present invention, a method for latching a door against a frame includes the steps of inserting a pin mounted to the door into a first slot on a latch bar mounted to the frame; inserting a handle pin mounted to a handle to a second slot on the latch bar; and rotating the handle so that the pin urges the latch bar in a first direction so that the first slot cammingly contacts the first pin to urge the door into a closed position.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract included below, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF THE INVENTION

Figure 1:
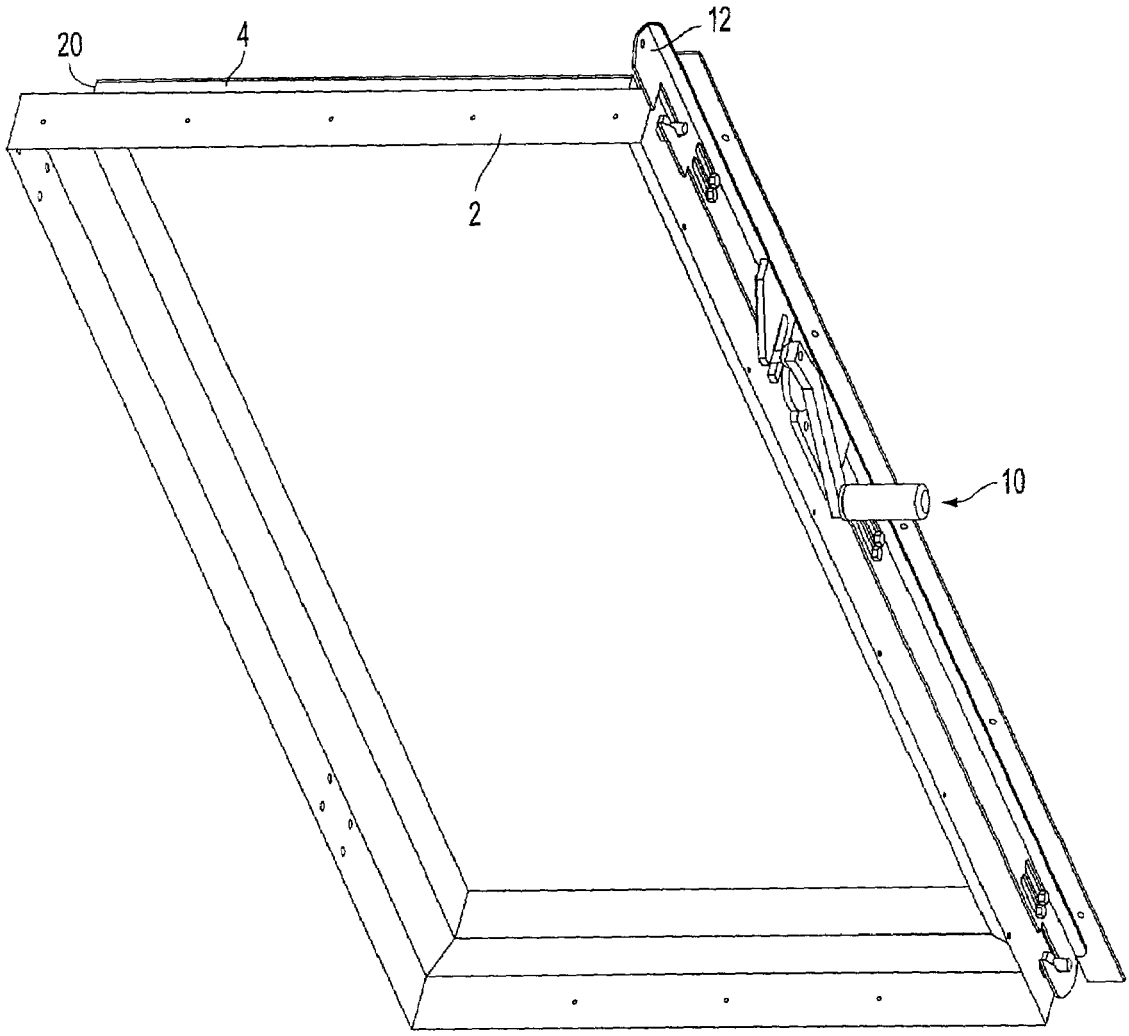
FIG. 1 is a perspective view of a door and frame having a latch according to the present invention, shown with the door in a closed and locked position.
Figure 2:
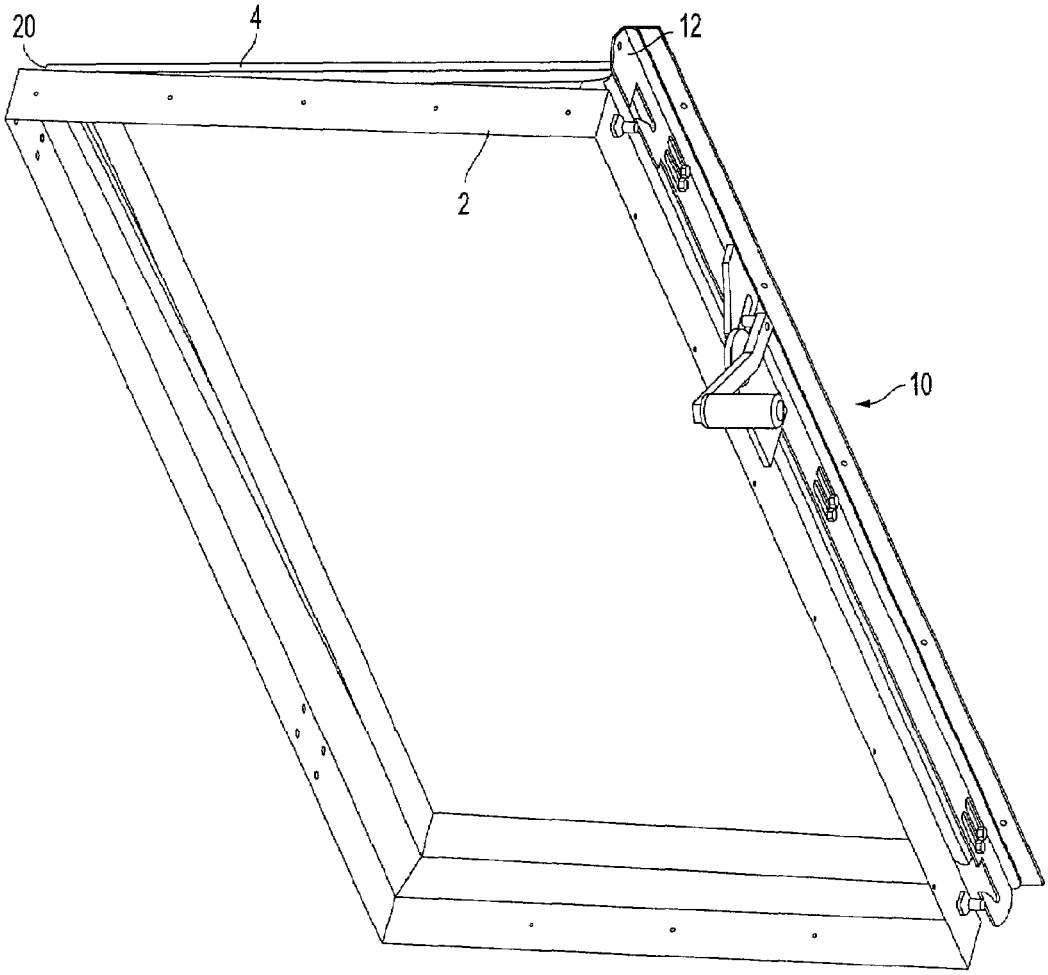
FIG. 2 is a perspective view of a door and frame having a latch according to the present invention, shown with the door in an unlocked and partially open position.
Figure 3:
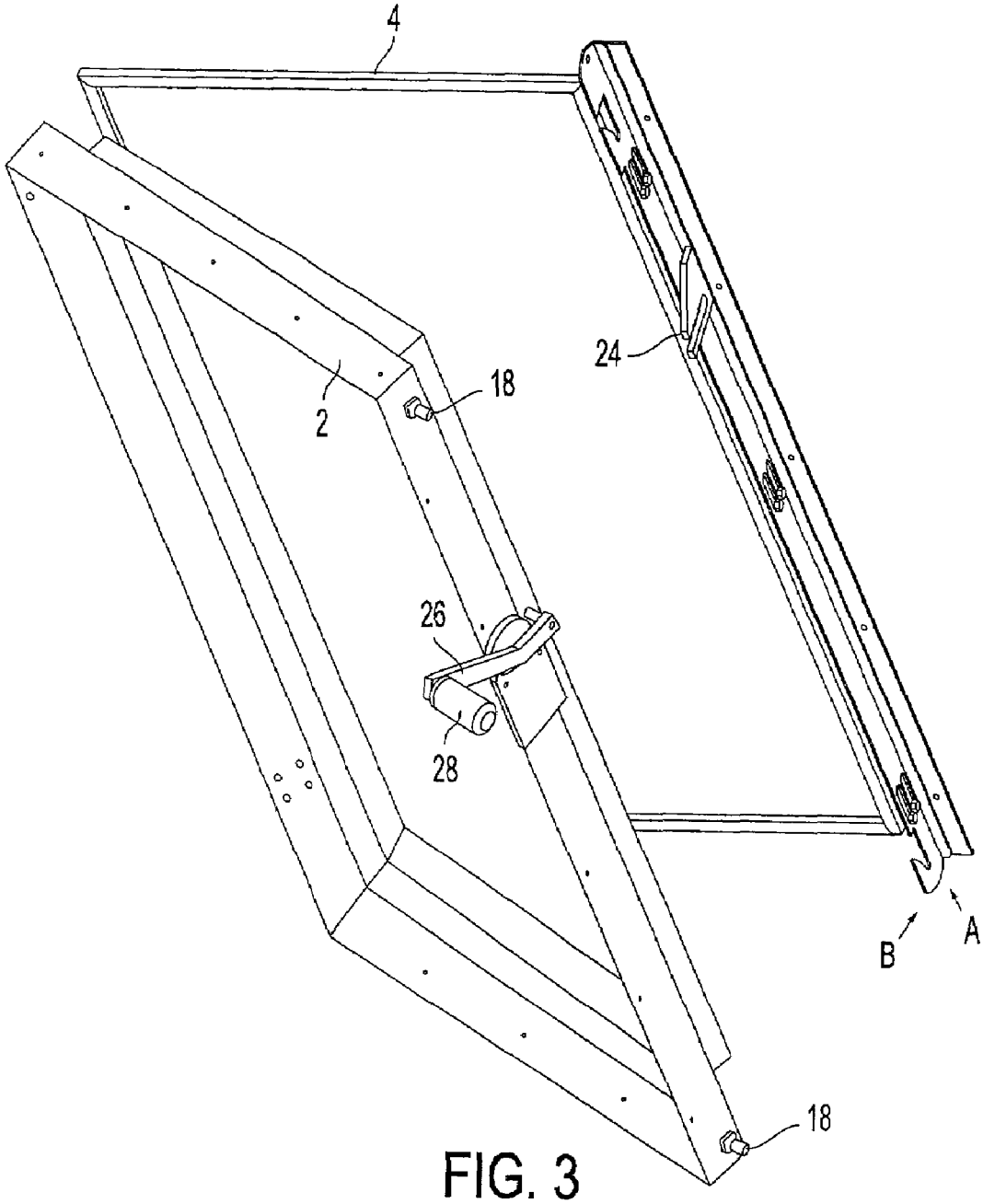
FIG. 3 is a perspective view of a door and frame having a latch according to the present invention, shown with the door in an unlocked and more fully open position than in FIG. 2.

The present invention provides a device and method for latching a door 2 closed against a frame 4. Referring generally to FIGS. 1–6, in a preferred embodiment, the latch device 10 includes a movable latch bar 12. The latch bar 12 has a first slot 14 with a cam surface 16 that contacts a door pin 18, or other suitable engaging element, that projects from the edge of the door 2 opposite the door hinge 20. The door 2 has a hinge 20 on one side, and the door pin 16 extends outwardly from the side of the door 2 on the opposite side from the hinge 20. One or more door pins 18 and corresponding first slots 14 may be employed, depending on, for example, the door size and the load on the door.

Figure 4:
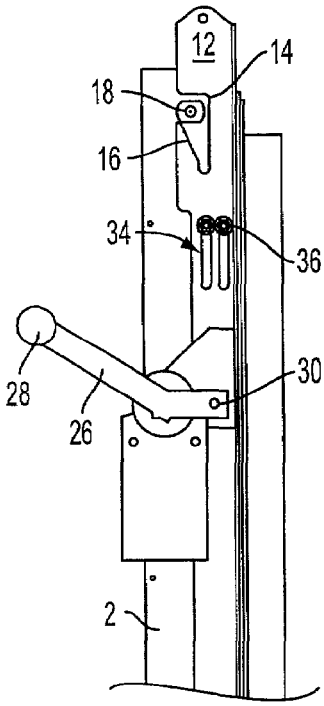
FIG. 4 is a side view of a door and frame showing the door closed and the latch in an unlocked position.
Figure 5:
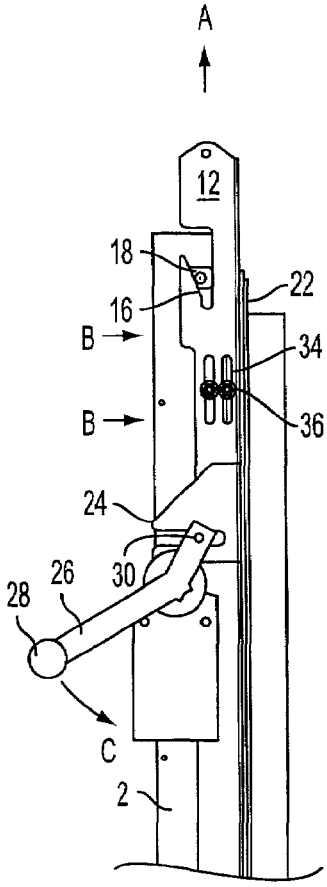
FIG. 5 is a side view of a door and frame showing the door closed and the latch in a partially locked position.

The latch bar 12 is preferably mounted on the frame of the door 2 generally adjacent the edge of the door that has the door pin 18, and the latch bar 12 may reciprocate in a vertical direction between locked and unlocked positions. Referring to FIG. 4, the latch bar 12 has a first slot 14 with a cam surface 16 so that when the latch bar 12 is in an unlocked position, the door pin 18 is unobstructed and the door 2 is therefore free to swing between open and closed positions with the door pin 18 free to enter and exit the first slot 14. Referring to FIG. 5, when the door 2 is closed, or nearly closed, the door pin 18 enters the first slot 14, and movement of the latch bar 12 in a latching direction A will cause the cam surface 16 to contact the door pin 18 and urge the door pin 18 in the direction B towards a more fully closed position. In some embodiments, the door 2 may have a gasket 22 between the door 2 and frame 4. The latch bar movement in direction A causes a door closing force in direction B that compresses the gasket 22.

In a preferred embodiment, the latch bar 12 is reciprocated by actuation of a manually operable assembly. A preferred latch operating assembly includes a second slot 24 provided on the latch bar 12. The second slot 24 is preferably oriented substantially perpendicular to the direction of movement of the latch bar 12. A rotating handle lever 26 is pivotally mounted to the edge of the door 2 opposite to the hinged side of the door. The rotating handle lever 26 rotates about a handle axis and has a handle 28 and one end and a handle pin 30 at its other end.

As shown in FIG. 4, once the door 2 is in a partially closed position, the handle pin 30 will enter the second slot 24 and the door pin 18 enters the first slot 14. At this point the handle is rotated in a downward direction C as shown in FIG. 5 so that the handle pin 30 urges the second slot 24 upwardly in the latch closing direction A, camming the door pin 18 in the closing direction B.

Figure 6:
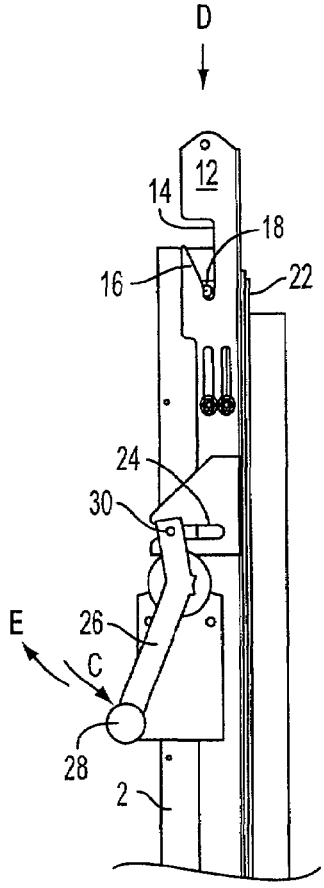
FIG. 6 is a side view of a door and frame showing the door closed and the latch in a fully locked position.

As discussed in more detail below, in a preferred embodiment, rotation of the handle causes the latch bar 12 to move past a top dead center position into a locked position shown in FIG. 6. In this way, rotation of the handle lever 26 urges the latch bar 12 in the closing and locking direction A so that the cam surface 16 on the first slot 14 urges the door pin 18 in the closing direction B so as to fully close the door 2 against the frame 4, compressing any intermediate gasket 22 that may be present.

Figure 8:
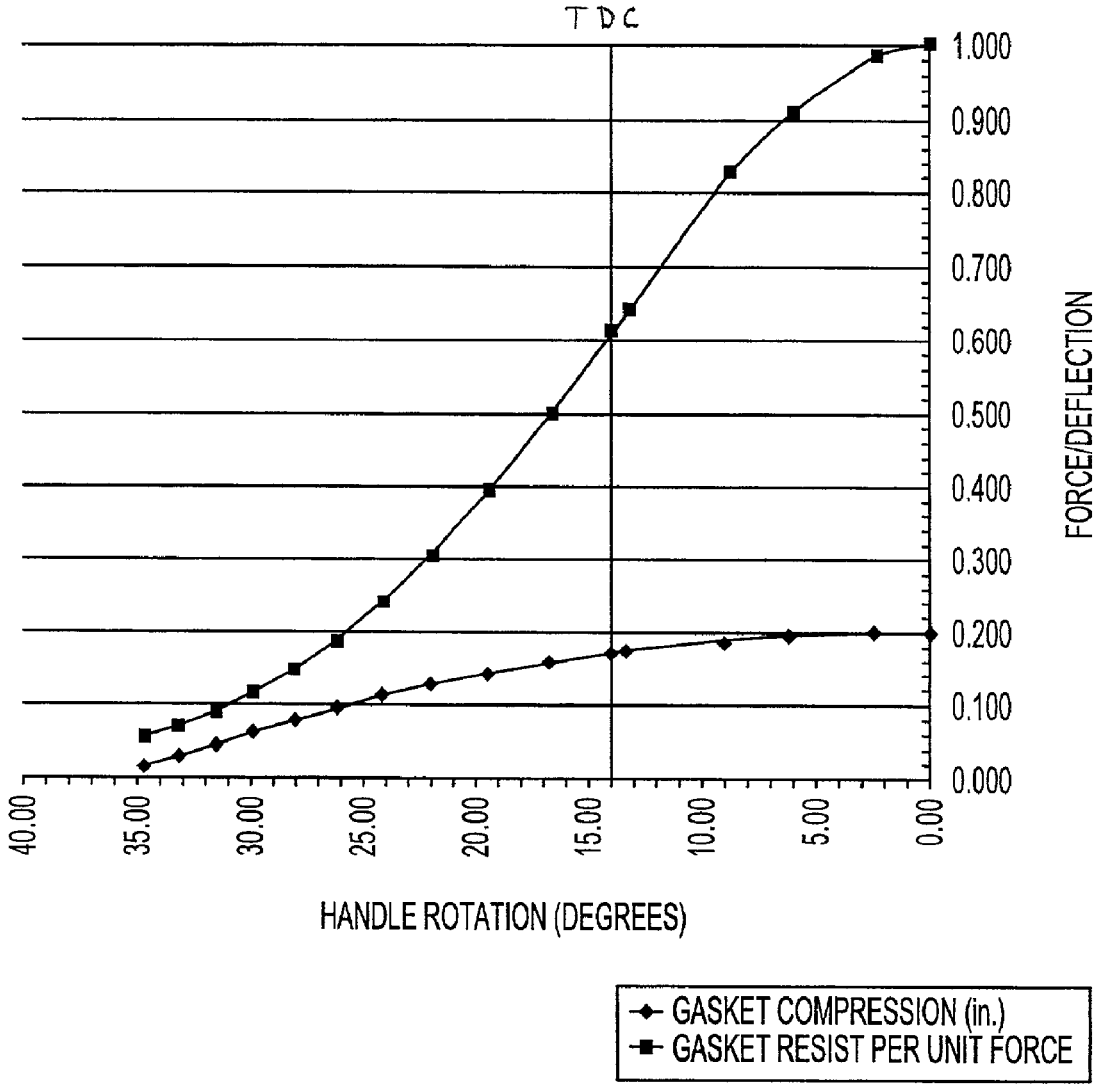
FIG. 8 is a graph showing an example of a relationship between gasket compression, gasket resisting force and degree of handle rotation.

In a preferred embodiment, the axis of the handle lever 26 and the positions of the handle pin 30 and the second slot 24 are arranged so that rotation of the handle lever 26 in the latching direction C occurs through a first range of rotation R 1 at which the torque on the handle increases as the door is urged closed, as shown in FIG. 8. The handle 34 then reaches a "top dead center" point of maximum compressive force at which the door 2 is urged shut with a predetermined force. This "top dead center" point is represented by the vertical line in FIGS. 8–10 and occurs in between the positions shown in FIGS. 5 and 6.

Figure 7:
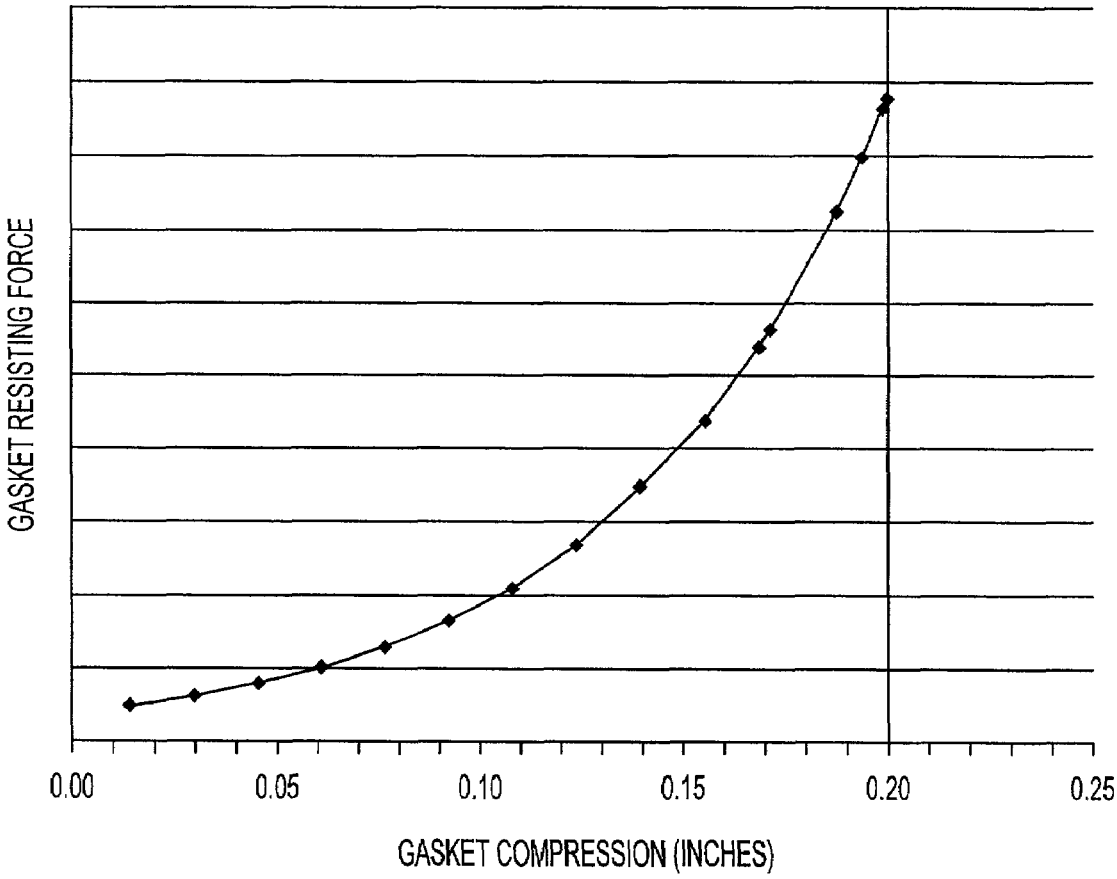
FIG. 7 is a graph showing an example of a relationship between gasket resisting force and gasket compression.

The invention can be suitable for doors with a gasket 22 having a springback resisting force that increases with gasket compression, in a relationship such as shown in FIG. 7. The gasket 22 may be affixed to a surface of the door 2 so that it is compressed against the frame 4 when the door 2 is closed. In embodiments with such a gasket 22, the door will be therefore compressing the gasket with a predetermined degree of force at the "top dead center" point, because the spacing between the door and frame occupied by the gasket will have a predetermined value.

Figure 9:
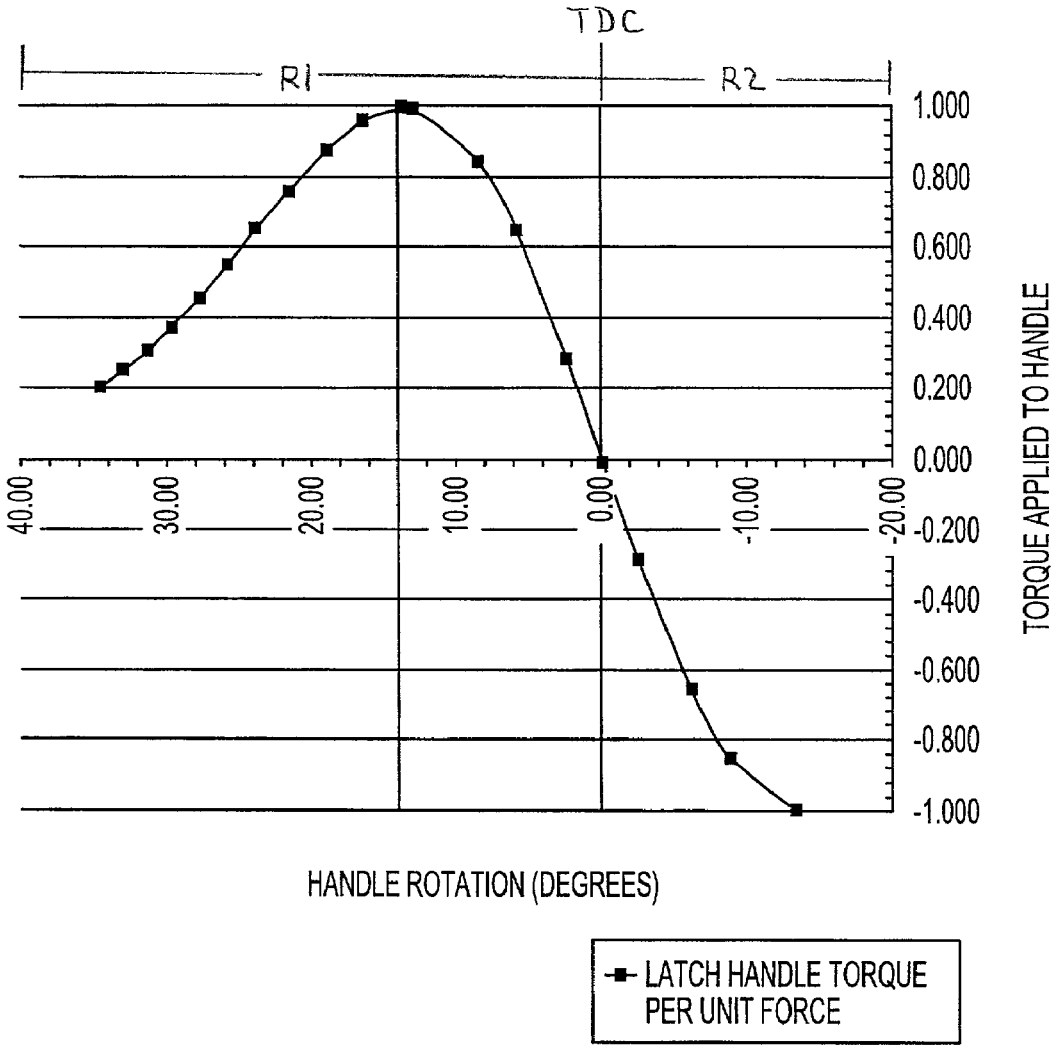
FIG. 9 is a graph showing an example of a relationship between handle rotation and torque applied to the handle.

As shown in FIG. 9, in operation to latch the door, the handle 26 is rotated in direction C in a predetermined range of rotation R2 past the "top dead center" location, which actually permits some movement of the latch bar in the unlatching direction D. The handle 26 is prevented by a stop from further rotation in direction C, so that this past-center (or over-center) movement causes the reaction force in the latch (resulting from the compression of the gasket, or simply from compressive forces between the door and frame where no gasket is present) to tend to hold the latch in the closed, latched position.

Figure 10:
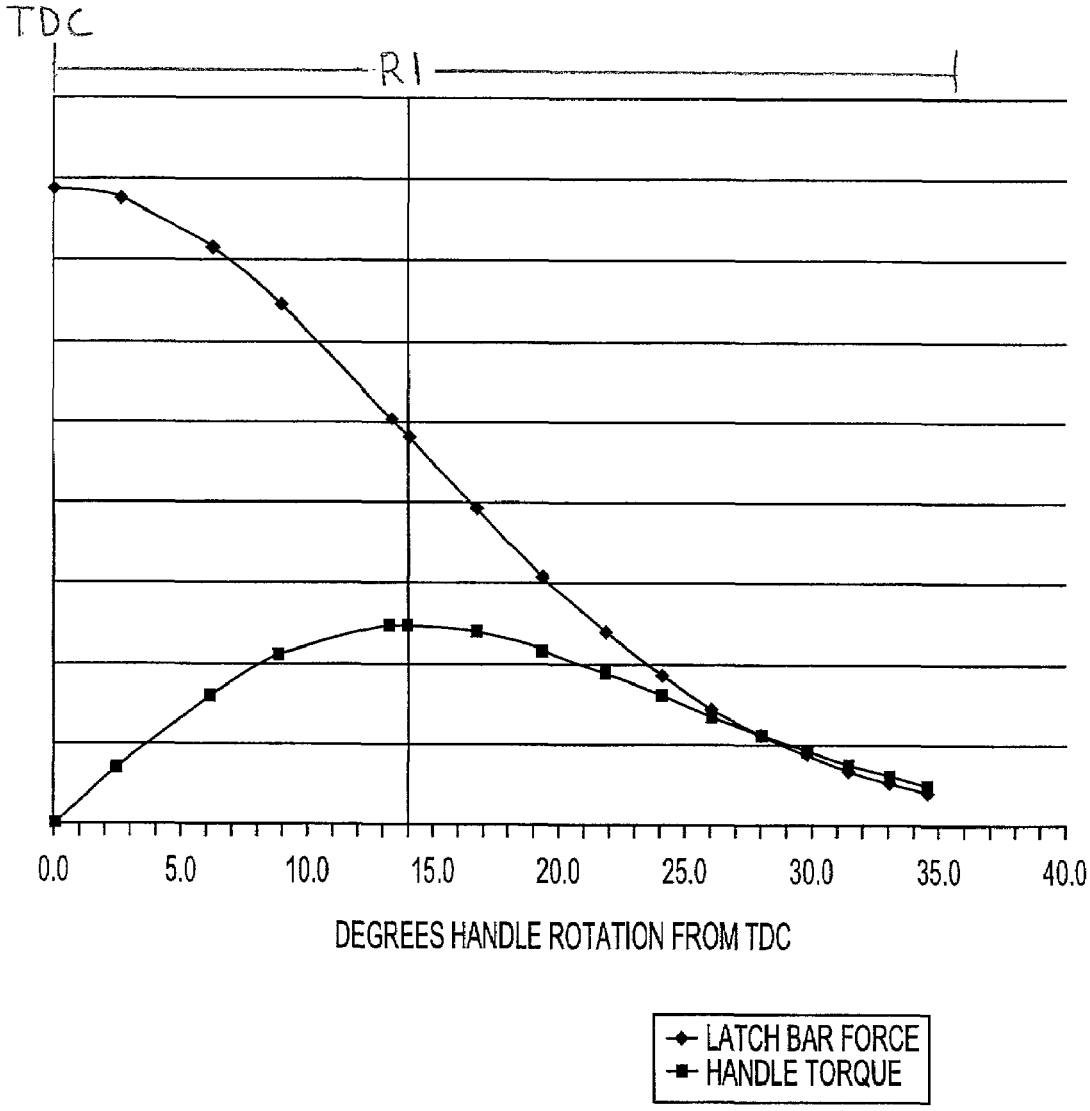
FIG. 10 is a graph showing an example of a relationship between latch bar force, handle torque and degree of handle rotation.

FIGS. 9 and 10 show that the maximum handle torque occurs in this embodiment approximately 14 degrees before reaching top dead center. The latch bar force is greatest at top dead center as show in FIG. 10.

To unlatch the door, a force is required to be applied against this over-center force in order to rotate the latch in the unlatching direction E past the "top dead center" point C. Therefore, the door tends to remain closed and latched until a user applies sufficient pressure in the unlatching direction E to move past top dead center. Once that point is passed, the gasket force will push the door open.

In a preferred embodiment, the latch bar 12 may be biased by gravity or by a spring or other suitable biasing device into the unlocked position, so that when the door is open, the latch bar remains in the unlocked position, available to receive the door pin 18 and the door handle pin 30 as the door swings closed. The handle lever 26 can be similarly biased into a position corresponding to the unlocked position. The handle pin 30 will align with and engage the second slot 24 as the door 2 swings closed.

In the preferred embodiment, the latch bar 12 is shown mounted to the door frame 4 on the side opposite of the hinge 20. Two door pins 18 are used along with two first slots 14. Depending upon variables such as the size of the door, the load on the door, and the degree of gasket compression desired, the number of door pins 18 and corresponding cam slot openings 14 may be varied to provide the desired latching force. Also, the latch bar 12 is illustrated having reciprocal motion relative to the door frame 4 via guide slots 34 in the latch bar 12 and guide pins 36 attached to the door frame 4. Other suitable methods of supporting the latch bar 12 for reciprocal movement may be used.

The invention may be used with doors on a wide variety of devices, including ovens, microwave ovens, refrigerators or other devices.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in art, it is not desired to limit the invention to the exact construction and operation illustrated and described, and accordingly, all suitable modifications and equivalents may be resorted to, falling within the scope of the invention.

What is claimed is:

1. An apparatus for latching a door against a frame, comprising;

a door pin extending from the door;

a handle lever rotatably mounted to the door and having a handle pin extending therefrom; and a latch bar mounted to the frame and configured for reciprocating travel relative to the frame, the latch bar completely defining a first slot configured to reciprocate substantially linearly and a cam surface adapted to receive said door pin, and a second slot adapted to receive said handle pin;

wherein said latch bar and handle have a first unlatched position where said handle pin enters said second slot and said door pin enters said first slot, and a second latched position where said handle pin contacts said second slot and said cam surface bears against said door pin, and wherein rotation of said handle from the first position to the second position causes said handle pin to bear against said second slot, moving said latch bar in a latching direction from the first position to the second position, so that said first slot on said cam surface bears against said door pin and urges the door in a closing direction.

2. An apparatus according to claim 1, wherein during movement from the first position to the second position, said handle rotates past a top dead center position so a reaction force retains said latch bar and handle in the second position.

3. An apparatus according to claim 1, wherein a compressible gasket is provided between the door and the frame.

4. An apparatus according to claim 3, wherein said gasket is compressed by a predetermined amount when said latch bar and handle are in the second position.

5. An apparatus according to claim 1, wherein the door is hinged to the frame at one side of the door, and said handle is mounted to the door at an opposite side of the door from the hinged side.

6. An apparatus according to claim 1, wherein the door is an oven door.

7. An apparatus according to claim 1, wherein said handle rotates about a first axis, and has a handle portion on one side of the first axis, and said handle pin is on the other side of the axis, and wherein said second slot is a substantially straight slot extending substantially perpendicular to the direction of reciprocating travel of said latch bar.

8. An apparatus according to claim 1, wherein said latch bar is biased towards the first position.

9. An apparatus according to claim 1, wherein said handle is biased towards the first position.

10. An apparatus according to claim 1, wherein when said latch bar and said handle are in the first position, said door pin is unobstructed by said first slot so that the door is unlatched.

11. An apparatus for latching a door against a frame, comprising:

a first engagement means extending from the door;

a second engagement means mounted to the frame including a slot configured to move substantially linearly and cooperating with said first engagement means, said first and second engagement means movable between a first position where the door is unlatched and a second position where said first and second engagement means latches the door closed; and actuating means mounted to the door for actuating the second engagement means to move between the first and second positions, the actuating means including a rotating handle having a handle pin extending therefrom that contacts a slot movable with the second engagement means to move the second engagement means from the first to the second position when the handle is rotated.

12. An apparatus according to claim 11, wherein said handle rotates past a top dead center position so that a reaction force retains said second engagement means in said second position.

13. An apparatus according to claim 11, wherein a compressible gasket is provided between the door and the frame.

14. An apparatus according to claim 11, wherein said handle rotates about a first axis, and has a handle portion on one side of the first axis, and said handle pin is on the other side of the axis, and wherein said slot is a substantially straight slot extending perpendicular to the direction of reciprocating travel of said latch bar.

15. A method for latching a door against a frame, comprising the steps of:

inserting a door pin mounted to the door into a first slot completely defined by a latch bar mounted to the frame;

inserting a handle pin mounted to a handle into a second slot on the latch bar, wherein the handle is mounted to the door; and rotating the handle in a first direction so that the door pin urges the latch bar in a first direction so that the first slot moves substantially linearly and cammingly contacts the door pin to urge the door into a latched position.

16. A method according to claim 15, wherein a compressible gasket is provided between the door and the frame.

17. A method according to claim 15, wherein said handle rotates about a first axis, and has a handle portion on one side of the first axis, and said handle pin is on the other side of the axis, and wherein said second slot is a substantially straight slot extending substantially perpendicular to the direction of reciprocating travel of said latch bar.

18. A method according to claim 15, wherein the step of rotating the handle further comprises the step of rotating the handle past a top dead center position so that a reaction force retains the latch bar and handle in the latched position.

19. A method according to claim 15, further comprising the steps of:

rotating the handle in a second direction opposite the first direction so that the door pin engages the latch bar in a second direction so that the first slot releases the door pin.

* * * * *